US005416380A

United States Patent [19]

Horiuchi

[11] Patent Number: 5,416,380

[45] Date of Patent: May 16, 1995

[54] COLOR SELECTION MECHANISM FOR CATHODE RAY TUBE AND ARM MEMBER FOR THE SAME

[75] Inventor: Yoshirou Horiuchi, Kanagawa

[73] Assignee: Sony Corporation, Tokyo, Japan

[21] Appl. No.: 51,538

[22] Filed: Apr. 26, 1993

[30] Foreign Application Priority Data

Apr. 27, 1992 [JP] Japan ..... 4-131399

[51] Int. Cl.[6] ..... H01J 29/81

[52] U.S. Cl. ..... 313/407; 313/402; 313/403; 313/404

[58] Field of Search ..... 313/402, 403, 404, 407

[56] References Cited

U.S. PATENT DOCUMENTS 3,529,199 9/1970 Duistermaat et al. ..... 313/404
4,495,437 1/1985 Kume et al. ..... 313/403
4,780,641 10/1988 Hashiba et al. ..... 313/404

FOREIGN PATENT DOCUMENTS 2005068 4/1979 United Kingdom ..... 313/404

*Primary Examiner*—Sandra L. O'Shea
*Assistant Examiner*—Matthew J. Esserman
*Attorney, Agent, or Firm*—Hill, Steadman & Simpson

[57] ABSTRACT

An arm member for a color selection mechanism of a color cathode ray tube which is reduced in weight, can be produced at a reduced cost, can cope with a model change of a cathode ray tube readily and can be worked readily with a high degree of accuracy without the necessity of a special material and a color selection mechanism employing the arm member are disclosed. The color selection mechanism comprises a pair of support bars extending substantially in parallel to each other, a pair of arm members joined to and extending substantially in parallel to each other between the bars, and a mask having a plurality of parallel ribbon-shaped grid elements extending under tension between and joined to the bars. Portions of the arm members at which the arm members are joined to the bars have surfaces having complementary shapes to those of the bars. The arm members have opening areas formed therein in an opposing relationship to each other.

4 Claims, 5 Drawing Sheets

COLOR SELECTION MECHANISM FOR CATHODE RAY TUBE AND ARM MEMBER FOR THE SAME

BACKGROUND OF THE INVENTION

1. Field of the Invention

This invention relates to a color selection mechanism for a cathode ray tube and an arm member adapted to hold thereon two frames or bars for supporting a mask of such color selection mechanism.

2. Description of the Related Art

Cathode ray tubes of various forms are conventionally known, and in a conventional color cathode ray tube of a certain form, a color selection mechanism has such a structure as shown in FIG. 4. Referring to FIG. 4, the color selection mechanism includes a pair of arm members 10, a pair of frames or support bars 12 and a mask 14. The mask 14 is a so-called aperture grill formed from a steel plate and having grid-like apertures 14A formed therein. It is to be noted that, in FIG. 4, a considerable portion of the mask 14 is omitted. The mask 14 is welded to and held taut on the frames or bars 12. The arm members 10 are joined to the frames or bars 12 by welding. Each of the conventional arm members 10 is formed from either a hollow member or a solid member and has a cross section of such an angular shape or a circular shape as shown in FIG. 5(A), 5(B) or 5(C). Each of the arm members 10 is produced by shaping such solid or hollow member into a profile of predetermined dimensions by presswork and then machining joining portions thereof, at which it is to be joined to frames or bars, so that it may have the shapes coincident with the shapes of curved surfaces of the frames or bars.

When a solid member formed by drawing is used as a material for an arm member, the arm member is heavy in weight, and it is difficult to reduce the weight of the color selection mechanism or a large size cathode ray tube. Meanwhile, a seamless pipe or a welded tube, which may be used for an arm member, is itself high in cost. Further, when a seamless pipe or a welded tube is actually used, secondary working to obtain a predetermined thickness and a predetermined sectional shape using a dice is required, and accordingly, the working cost is high. Besides, when it becomes necessary to change the size, profile and so forth of the arm member as a model change of a color cathode ray tube takes place, it is necessary to change the profile, thickness and so forth of the material itself.

When an arm member is produced from a hollow member, when the arm member 10 is welded to a frame 12, gas is produced as a result of welding, and the gas thus produced is enclosed in the hollow portion of the arm member. Consequently, there is a problem that degasification processing must be performed. Further, it sometimes occurs that washer liquid may enter the hollow portion of the arm member at a washing step after welding and post-processing for the washer liquid must necessarily be performed. Accordingly, the assembling operation of the color selection mechanism is complicated.

Furthermore, a portion of a frame at which an arm member is joined normally has a complicated curved surface. Accordingly, an arm member must be worked so that, after a solid member or a hollow member is worked by press work, the shape of a joining portion of the arm member to a frame may be Complementary to the shape of the curved surface of the frame. It is difficult to perform such working with a high degree of accuracy, and also there is a problem that the cost is increased thereby.

As described above, a conventional arm member has problems that it is high in cost and it is difficult to reduce the weight of it, that it is difficult to cope with a model change of a cathode ray tube, and that it is difficult to work and is difficult to raise the working accuracy. Also there is a problem that many steps are required for an assembling operation of a color selection mechanism.

SUMMARY OF THE INVENTION

It is an object of the present invention to provide an arm member for a color selection mechanism of a color cathode ray tube which is reduced in weight and can be produced at a reduced cost.

It is another object of the present invention to provide an arm member for a color selection mechanism of a color cathode ray tube which can cope with a model change of a color cathode ray tube readily.

It is a further object of the present invention to provide an arm member for a color selection mechanism of a color cathode ray tube which can be worked readily with a high degree of accuracy without the necessity of a special material.

It is a still further object of the present invention to provide a color selection mechanism provided with such arm member.

In order to attain the objects described above, according to an aspect of the present invention, there is provided a grid device, which comprises a pair of support bars extending substantially in parallel to each other, a pair of resilient support members or arm members joined to the support bars and extending substantially in parallel to each other between the support bars, and a mask having a plurality of parallel ribbon-shaped grid elements extending under tension between and joined to the support bars, portions of the support members at which the support members are joined to the support bars having surfaces having complementary shapes to those of the support bars, the support members having opening areas formed therein in an opposing relationship to each other.

In the grid device, the resilient support members are reduced in weight since the opening areas are provided therein. Further, when the resilient support members are welded to the support bars, gas produced by welding will not be enclosed in the insides of the arm members, and besides, washing at a washing step after welding can be performed readily. Furthermore, each of the resilient support members can be manufactured by cutting a flat plate, which is an expensive material for universal use, and performing deep drawing of the same. Accordingly, the material itself is inexpensive, and the material cost of the grid device can be reduced and also the working accuracy of the resilient support members is high. Further, no secondary working is required for the resilient support members, and consequently, the production cost of the grid device can be reduced. Furthermore, also when a model change of a cathode ray tube takes place so that it becomes necessary to change the size, shape and so forth of the resilient support members, the material itself need not be changed but it is only required to change the press apparatus.

According to another aspect of the present invention, there is provided an arm member for being joined to a pair of frames for holding a mask for a color selection mechanism of a cathode ray tube, wherein each of joining portions at which the arm member is to be joined to the frames has a surface of a complementary shape to the outer profile of the corresponding frame, and the arm member has an opening area provided at a portion thereof. Preferably, the arm member has a section of a substantially channel shape, and the opening area corresponds to an open portion of the channel shape.

The arm member is reduced in weight since the opening area is provided therein. Further, when the arm member is welded to a frame or support bar, gas produced by welding will not be enclosed in the inside of the arm member, and besides, washing at a washing step after welding can be performed readily. Furthermore, the arm member can be manufactured by cutting a flat plate, which is an expensive material for universal use, and performing deep drawing of the same. Accordingly, the material itself is inexpensive, and the material cost can be reduced and also the working accuracy of the arm member is high. Further, no secondary working is required for the arm member, and consequently, the production cost can be reduced. Furthermore, also when a model change of a color cathode ray tube takes place so that it becomes necessary to change the size, shape and so forth of the arm member, the material itself need not be changed but it is only required to change the press apparatus. Further, since the arm member can be produced by deep drawing of a plate element, the joining portion of the arm member need not be machined later so that it may coincide with the profile of the curved surface of a frame or bar, and besides, the arm member can be produced by press work with a high degree of accuracy.

According to a further aspect of the present invention, there is provided a color selection mechanism for a color cathode ray tube, which comprises a mask, a pair of frames or bars for holding the mask thereon, and a pair of arm members joined, at joining portions thereof, to the two frames or support bars and having, at the joining portions thereof, surfaces of complementary shapes to the outer profiles of the frames or bars, each of the arm members further having an opening area provided at a portion thereof. Preferably, the opening areas of the arm members are opposed to each other.

With the color selection mechanism, since such an arm member as described above is employed for the arm members, similar effects to those of the arm member can be attained.

The above and other objects, features and advantages of the present invention will become apparent from the following description and the appended claims, taken in conjunction with the accompanying drawings in which like parts or elements are denoted by like reference characters.

BRIEF DESCRIPTION OF THE DRAWINGS

FIGS. 3(C) and 3(D) are a perspective view and a sectional view, respectively, of a further arm member according to the present invention while

DESCRIPTION OF THE PREFERRED EMBODIMENTS

Figure 1:
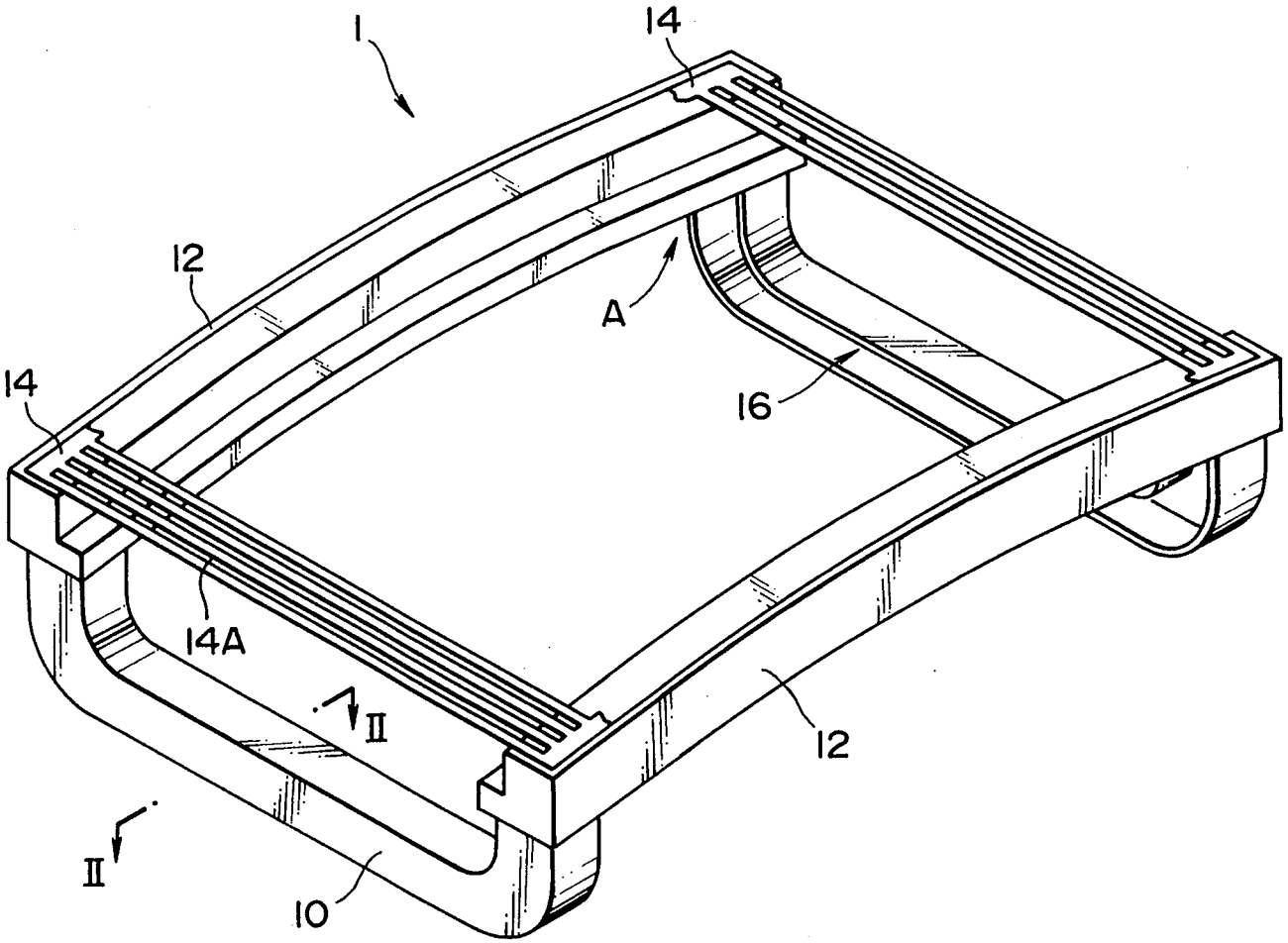
FIG. 1 is a perspective view of a color selection mechanism which employs an arm member according to the present invention.

Referring first to FIG. 1, there is shown a color selection mechanism which employs an arm member according to the the present invention. The color selection mechanism shown is generally denoted at 1 and includes a pair of arm members 10 extending substantially in parallel to each other, a pair of frames or support bars 12 extending substantially in parallel to each other, and a mask 14 having a plurality of parallel ribbon-shaped grid elements extending under tension between and joined to the frames or bars 12. The mask 14 is a so-called aperture grill formed from a steel plate and has grid-like apertures 14A formed therein. It is to be noted that, in FIG. 1, a considerable portion of the mask 14 is omitted. The mask 14 is welded to and held on the frames or bars 12.

Figure 2A:
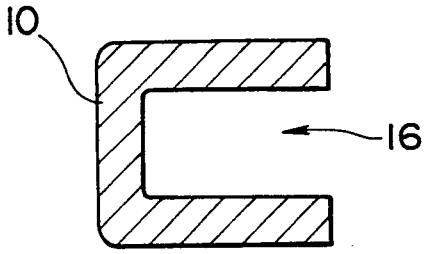
FIG. 2(A) is an enlarged sectional view of the arm member of FIG. 1.

The arm members 10 are joined to the frames or bars 12 by welding. Each of the arm members 10 has such a sectional shape as shown in FIG. 2(A) at a central portion thereof. In particular, referring to FIG. 2(A), the central portion of the arm member 10 has a channel shape. The dimensions of different portions of the channel-shaped section should preferably be, from the point of view of the strength of the arm member, such that the length of the cross bar of the channel shape be equal to or longer than the length of the side portions of the channel shape. An opening area 16 is thus provided on the arm member 10 and corresponds to an open portion of the channel shape. The arm members 10 are welded to the frames or bars 12 such that the opening areas 16 of them may be opposed to each other.

Figure 2B:
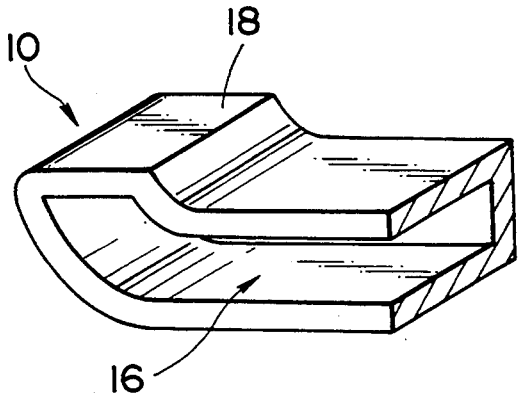
FIG. 2B is an enlarged perspective view of part of the arm member.

An outline of one of joining portions (corresponding to the portions denoted at A in FIG. 1) of each of the arm members 10 at which it is to be joined to frames or support bars is shown in a perspective view of FIG. 2(B). The joining portion 18 of the arm member 10 to a frame or bar has a surface having a complementary shape to the outer profile of the frame or bar. In particular, the joining portion 18 of the arm member 10 to a frame or bar has an outer surface of a profile substantially coincident with the outer profile of the frame or bar. In a conventional arm member formed from a hollow member, a hollow portion is present at a joining portion of the arm member to a frame or bar. In contrast, in the arm member shown in FIGS. 2(A) and 2(B), since the joining portion 18 of the arm member 10 to a frame or bar is constituted from a surface, the connection between the arm member 10 and the frame or bar 12 is strong comparing with that of the conventional arm member.

The arm member 10 can be formed by cutting or stamping a structural special steel plate of 4.5 mm thick made of, for example, Cr—Mo—Fe, which is a material for universal use, into a piece of a predetermined size and shaping the piece by deep drawing using a press apparatus. The length of the arm member 10 may be, for example, 35 cm. Further, the size of an outer side portion of the sectional shape shown in FIGS. 2(A) and 2(B) may be 21 mm long and 21 mm wide, and the height of the joining portion of the arm member 10 to a frame shown in FIG. 2(B) may be 29 mm. Since the arm member 10 is shaped by deep drawing using a press apparatus, the joining portion 18 of the arm member 10 to a frame or bar can be worked with a high degree of accuracy, and the joining portion 18 need not be machined at a subsequent step so that it may coincide with the outer profile of a frame or bar.

Figure 3A:
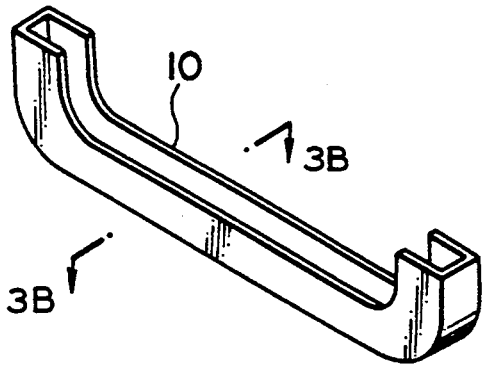
FIGS. 3(A) and 3(B) are a perspective view and a sectional view, respectively, of another arm member according to the present invention
Figure 3B:
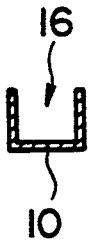
Figure 3C:
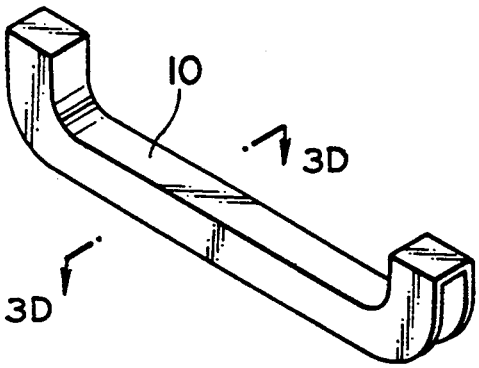
Figure 3D:
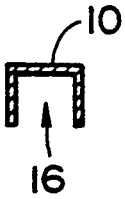
Figure 3E:
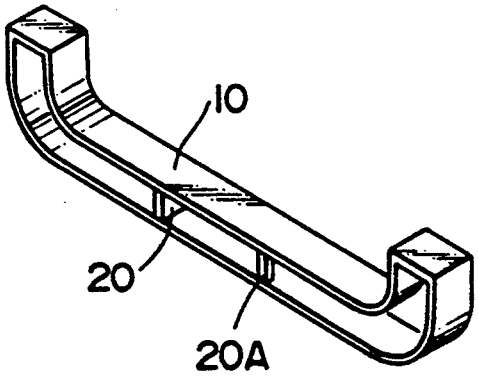
FIG. 3(E) is a perspective view of a still further arm member according to the present invention.
Figure 4:
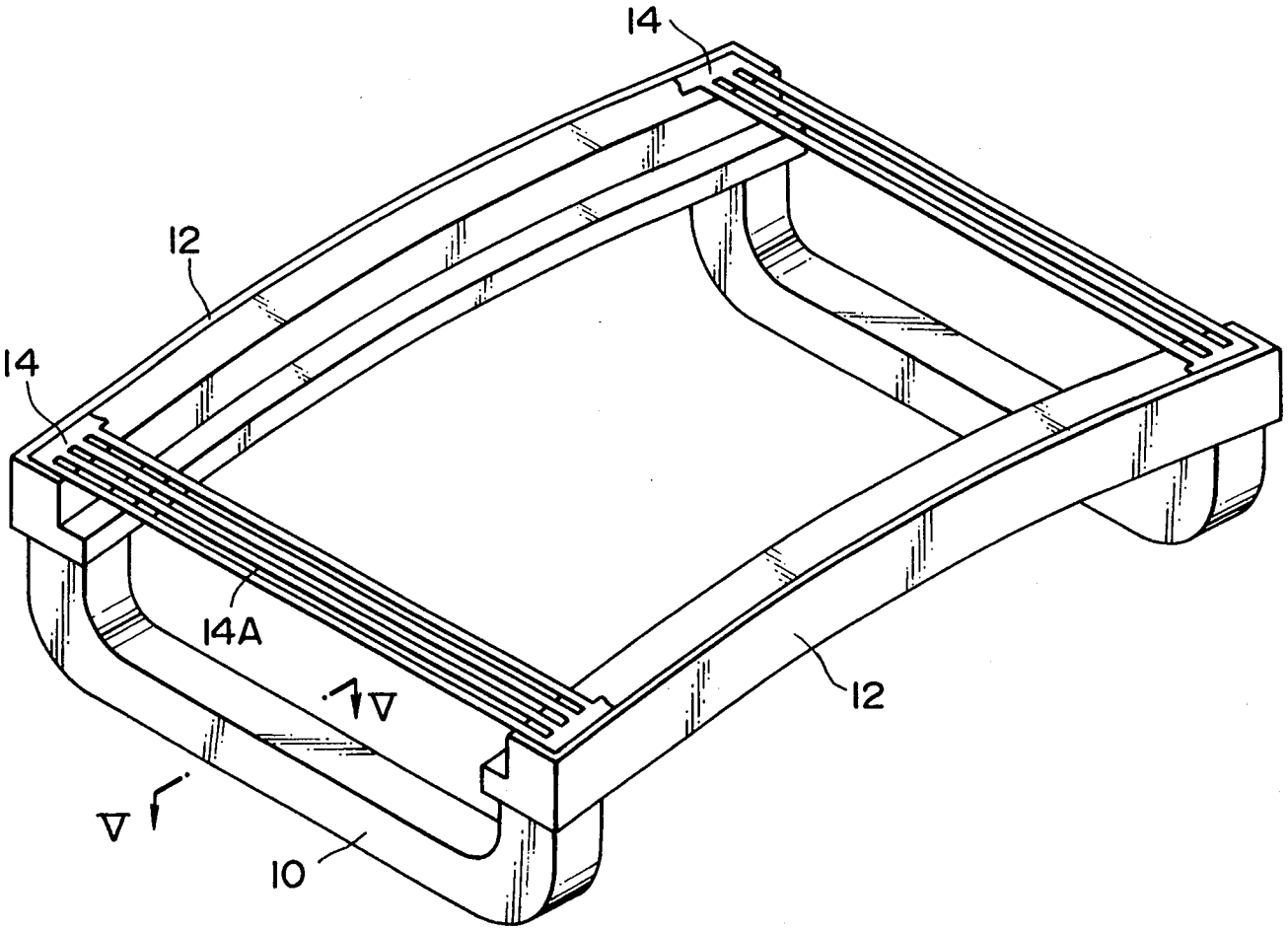
FIG. 4 is a perspective view of a color selection mechanism which employs a conventional arm member.
Figure 5A:
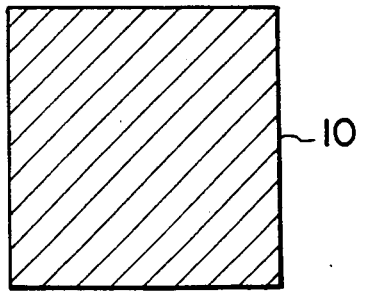
FIGS. 5(A), 5(B) and 5(C) are sectional views showing different sectional shapes of the conventional arm member.
Figure 5B:
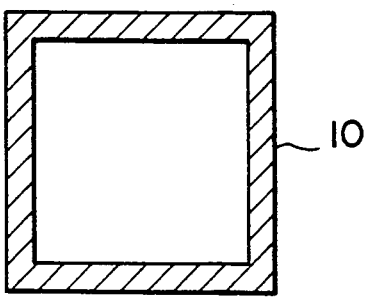
Figure 5C:
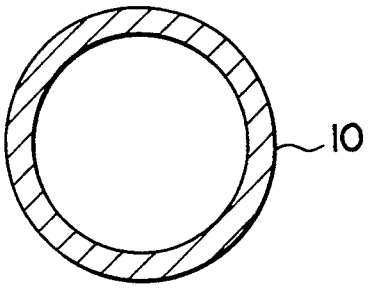

While the arm member and the color selection mechanism of the present invention have been described in connection with the preferred embodiments, the present invention is not limited to the embodiment. The dimensions and material of the arm member can be changed suitably in accordance with a color selection mechanism of a cathode ray tube. For example, the arm member may have any of such configurations as shown in FIGS. 3(A) to 3(E) in addition to the configuration shown in FIGS. 2(A) and 2(B). In particular, the arm member may have such a profile as shown in FIG. 3(A) and such a sectional shape as shown in FIG. 3(B) or may have such a profile as shown in FIG. 3(C) and such a sectional shape as shown in FIG. 3(D). Or, the arm member 10 may have a substantially C-shaped section wherein the opposite ends of the channel shape are bent or curved inwardly. Furthermore, a bridge 20 can be inserted in or a projection 20A can be formed on a hollow portion of the arm member 10 such that it extends in a perpendicular direction to the longitudinal direction of the arm member 10 as shown in FIG. 3(E) to ensure a high strength of the arm member.

Having now fully described the invention, it will be apparent to one of ordinary skill in the art that many changes and modifications can be made thereto without departing from the spirit and scope of the invention as set forth herein.

What is claimed is:

1. A grid device, comprising:

a pair of support bars extending substantially in parallel to each other;

a pair of resilient support members joined to said support bars and extending substantially in parallel to each other between said support bars; and a mask having a plurality of parallel ribbon-shaped grid elements extending under tension between and joined to said support bars;

portions of said support members at which said support members are joined to said support bars having surfaces having complementary shapes to those of said support bars;

said support members having a channel shaped cross-section with openings formed therein in an opposing relationship to each other.

2. An arm member for being joined to a pair of support bars for holding a mask for a color selection mechanism of a color cathode ray tube, wherein each of joining portions at which said arm member is to be joined to said bars has a surface of a complementary shape to the outer profile of the corresponding bar, and said arm member has a channel shaped cross-section with an open area provided at a position thereof.

3. A color selection mechanism for a color cathode ray tube, comprising:

a mask;

a pair of support bars for holding said mask thereon; and a pair of arm members joined, at joining portions thereof, to said two bars and having at said joining portions thereof, surfaces of complementary shapes to the outer profiles of said bars, each of said arm members further having a channel shaped cross-section with an open area provided at a portion thereof.

4. A color selection mechanism according to claim 3, wherein said open areas of said arm members are opposed to each other.

* * * * *